US005394702A

United States Patent [19]

Jochum

[11] Patent Number: 5,394,702

[45] Date of Patent: Mar. 7, 1995

[54] EXPLOSIVE POWDER CHARGE OPERATED SETTING TOOL

[75] Inventor: Peter Jochum, Meiningne, Austria

[73] Assignee: Hilti Aktiengesellschaft, Furstentum, Liechtenstein

[21] Appl. No.: 227,414

[22] Filed: Apr. 14, 1994

[30] Foreign Application Priority Data

Apr. 17, 1993 [DE] Germany ..... 43 12 567.0

[51] Int. Cl.[6] ..... B25C 1/14

[52] U.S. Cl. ..... 60/638; 60/632

[58] Field of Search ..... 60/638, 632

[56] References Cited

U.S. PATENT DOCUMENTS

| | | | |
|---|---|---|---|
| 2,575,071 | 11/1951 | Rockwell | 60/632 |
| 3,168,744 | 2/1965 | Kvarle | 227/8 |
| 3,204,400 | 9/1965 | Kvarle | 60/638 |
| 4,711,385 | 12/1987 | Jochum | 60/638 |

*Primary Examiner*—Ira S. Lazarus
*Assistant Examiner*—L. Heyman
*Attorney, Agent, or Firm*—Anderson Kill Olick & Oshinsky

[57] ABSTRACT

An explosive powder charge operated setting tool uses compressed propellant gases for returning a piston (1) from an end position to a starting position. The piston (1) is axially displaceable by the propellant gases within an axially extending guide bore (2*a*) in a piston guide (2). The propellant gases flow from the guide bore (2*a*) through a first opening (6) into an axially extending channel (5) outside the piston guide (2) and then through a second opening (7) in the region of the end position of the piston (1) back to the guide bore. After the piston (1) is driven into the end position, compressed propellant gases within the guide bore (2*a*) return the piston to the starting position where it impacts against the base (4*c*) of a cartridge carrier (4) located at the starting position. When the piston (1) is stopped, the cartridge carrier (4) is displaced to a limited extent opposite to the setting direction of the tool. To afford the limited displacement, the cartridge carrier (4) is connected to the housing part (3) laterally enclosing the piston guide (2) by sawtooth-shaped threads (3*a*, 4*a*) providing clearances.

8 Claims, 1 Drawing Sheet

EXPLOSIVE POWDER CHARGE OPERATED SETTING TOOL

BACKGROUND OF THE INVENTION

The present invention is directed to an explosive powder charge operated setting tool containing a piston guide forming a guide bore with a cartridge carrier at one end for receiving an explosive powder charge capable of propelling a piston by means of propellant gases from a rear starting position to a front end position. The cartridge carrier forms a rear stop for the piston after it is returned from the front end position. A channel located between the piston guide and a laterally enclosing housing part communicates through openings with the guide bore in the rear starting position and in the front end position.

In explosive powder charge operated setting tools of this type a piston is driven from the rear starting position into the front end position by propellant gases generated when the explosive powder charge is ignited. The piston drives bolts, nails and similar fastening elements directly into hard receiving materials, such as concrete, metal and the like.

To return the piston, after it has completed the driving operation, back into the starting position for the next driving operation, it is necessary to move the piston from its front end position to its rear starting position. In known tools this operation is effected in many ways.

For instance, it has been known to move the piston by means of a separate tappet or ram into its rear starting position. Such an operation has the disadvantage that it requires considerable time and involves the use of a separate tappet which can be easily lost.

Further, a mechanical return arrangement for the tool has been widely used and involves pulling the piston guide forward over the piston in its end position and subsequently moving the piston guide along with the piston rearwardly, whereby the piston ends up in the rear starting position.

This piston return procedure also requires a relatively long time period due to the special manipulating step, and is especially disadvantageous in multiple or series fastening element setting operations, such as performed by setting tools of the above type.

To avoid such special manipulating steps or handling operations, it has been known to effect the piston return by using propellant gases such as disclosed in EP 0 223 740. In this type of piston return, an opening is exposed in the region of the starting position of the piston, after the piston has begun to move following ignition of the powder charge, so that some of the propellant gases flow back into the guide bore in the piston guide through a channel and another opening in the region of the end position of the piston. These propellant gases, which have entered into the front end of the guide bore in the piston guide, are compressed by the piston and serve to drive the piston as they expand, after the completion of the driving step, returning the piston from the front end position into its rear starting position.

This known piston return operation has the advantage that it takes place completely automatically without any additional manual operation. The elimination of the mechanical operations, however, involves certain problems, whereby depending upon the quantity of the propellant gases the piston is driven with more or less force against the rear stop formed by the cartridge carrier. If the compressed propellant gases provide a strong returning force, there can be the disadvantage that a rebound effect is generated when the piston impacts the cartridge carrier and, as a result, the piston again moves over a certain distance in the driving or setting direction due to the rebound effect and does not assume its original rear starting position. Such an effect results in the development of an open or dead space with respect to the rear starting position, so that the desired output of the setting tool is not attained or the opening located in the region of the starting position remains open and a large share of the propellant gases escapes and is not available for driving the piston.

SUMMARY OF THE INVENTION

The primary object of the present invention is to provide an explosive powder charge operated setting tool in which a piston is returned to the starting position by using propellant gases, so that it is assured that the piston is returned to its rear starting position in the cartridge carrier which forms the rear stop.

In accordance with the present invention, the cartridge carrier of the setting tool is axially displaceable to a limited extent relative to the remaining parts of the tool. The limited displaceability of the cartridge carrier relative to the remaining parts of the tool is achieved by avoiding any rebound effect when the piston is returned from its front end position to its rear starting position by the action of compressed propellant gases. When the piston impacts against the rear stop formed by the cartridge carrier, the energy of the piston is transferred to the cartridge carrier due to the laws of impulse effects, so that the piston remains stationary and instead the cartridge carrier is displaced opposite to the setting direction. Since the displaceability of the cartridge carrier is effected within an extremely limited range, no disadvantageous dead space is developed.

A simple construction of the setting tool embodying the present invention is available, if the cartridge carrier is displaceable in the axial direction of the piston relative to the housing portion surrounding the piston guide. Preferably, the limited displaceability between the cartridge carrier and the housing part is achieved by a connection affording the limited displaceability. Such a connection provides stops on one of the two connected parts and counter stops at the other.

A threaded connection forming a certain clearance is provided as a connection between the cartridge carrier and the housing part. Such a threaded connection permits simple assembly and disassembly of the setting tool, for instance when tool parts require replacement or when the tool is disassembled for cleaning.

Among the large number of possible threaded connections, a sawtooth thread is suitable where the thread flanks inclined relative to the axis of the piston extend inwardly counter to the setting direction of the tool. Such sawtooth threads create conical faces and counter conical faces which run up on one another when the impact effect takes place. As a result, it is possible that a large portion of the energy is diverted into friction and heat in the conical and counter conical faces.

Such energy conversion introduced into the cartridge carrier can be further assisted, for instance into elastic deformation, preferably of the type where the cartridge carrier has slots open toward the end in the region of the threaded connection. As a result, the cartridge carrier becomes more elastic by the manner in which it is shaped in the region of the threaded connection, that is, in addition to the elasticity inherent in its material.

Accordingly, the rebound effect can be prevented by a very limited displaceability. Small displacement dimensions are sufficient, preferably in the range of 0.1 to 0.3 mm. With such small displacement dimensions, the displaceability of the cartridge carrier does not result in a disadvantageous dead space.

To avoid establishing a dead space resulting in a harmful effect, not only are the displacement dimensions important, but also the behavior of the cartridge carrier after a shock effect is significant. Accordingly, in the threaded connection of the present invention, the thread flanks of the cartridge carrier run-up against the counter flanks of the housing portion after the limited displaceability is achieved resulting in a reduced rebound effect moving the cartridge carrier in the setting direction into its intended position. Further, this effect is assisted by the elasticity or flexibility of the cartridge carrier, whether inherent in its material or achieved by its shape.

Mass relationships are also important in avoiding a rebound effect due to the impulse law. Accordingly, it is advantageous if the mass of the cartridge carrier corresponds at least to the mass of the piston. Preferably, the mass relationship is established so that the mass of the cartridge carrier corresponds to 1 to 3 times the mass of the piston. The factors influencing the mass relationships are determined especially by the friction relationships and the material properties of the parts involved.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
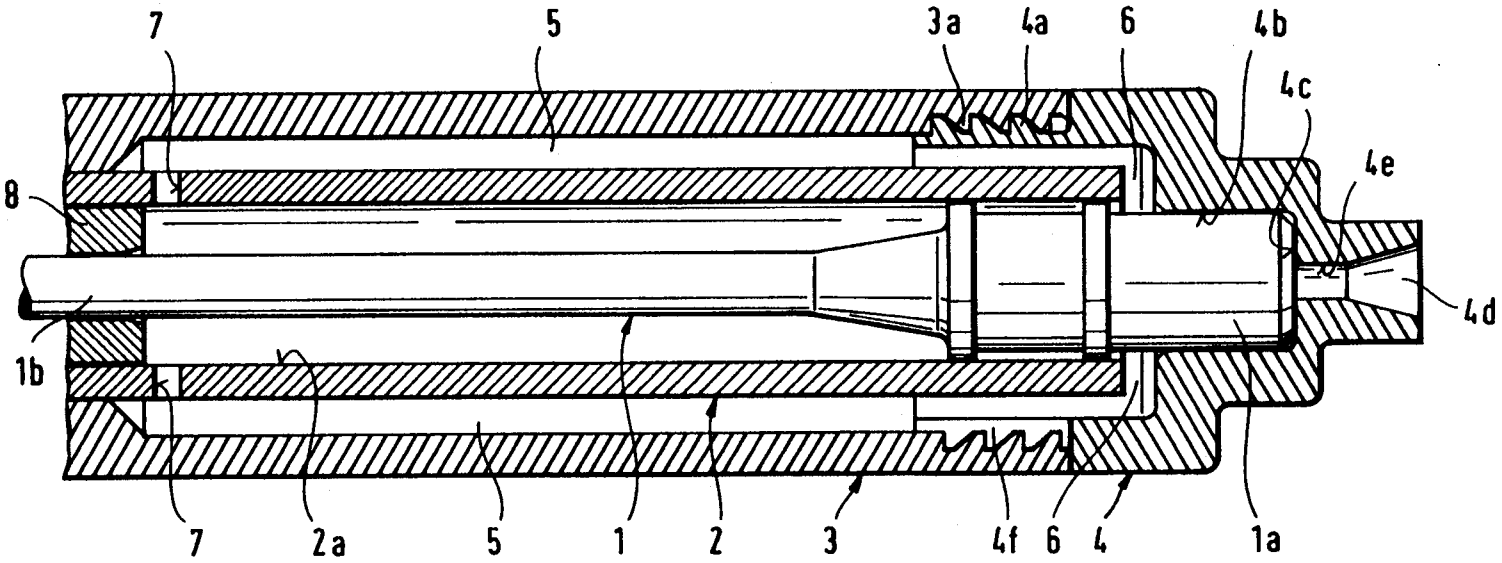
FIG. 1 is an axially extending sectional view of the parts of an explosive powder charge operated setting tool embodying the invention.

Since explosive powder charge operated setting tools are known and because their guides, ignition mechanisms, triggering mechanisms and the like have no influence on the present invention, FIG. 1 is limited to the parts of the tool essential to the present invention.

In FIG. 1 an axially extending piston 1 is guided within an axially extending tubular piston guide 2. As viewed in FIG. 1, the rear end of piston 1 and of the piston guide 2 is on the right and the front end is on the left, accordingly, in a fastening element setting operation the piston 1 is driven to the left within the piston guide 2. Piston guide 2 has a guide bore 2*a* for guiding the piston 1. The piston guide 2 is laterally enclosed by a housing part 3 with the rear end of the housing part connected to a cartridge carrier 4. A sawtooth-shaped thread 3*a*, 4*a* provides the connection between the housing part 3 and the cartridge carrier 4.

Further, FIG. 1 shows a receiving bore 4*b* in the carrier 4 for receiving the axially extending rear end part 1*a* of the piston 1. The base 4*c* of the receiving bore 4*b* forms a rear stop for the piston 1 in its rear starting position within the cartridge carrier 4. In its rear end, the cartridge carrier 4 has a conically-shaped cartridge chamber 4*d* connected to the receiving bore 4*b* by a cylindrically-shaped throughbore 4*e*.

An axially extending channel 5 is located between the housing part 3 and the piston guide 2 and extends rearwardly into the region of the cartridge carrier 4. Channel 5 is connected to the guide bore 2*a* of the piston guide 2 through an opening 6 in the region of the rear starting position and by another opening 7 in the region of the front end position. The opening 7 located in the end position region opens into the guide bore 2*a* adjacent a piston shank guide 8 serving to guide the piston shank 1*b*.

Figure 2:
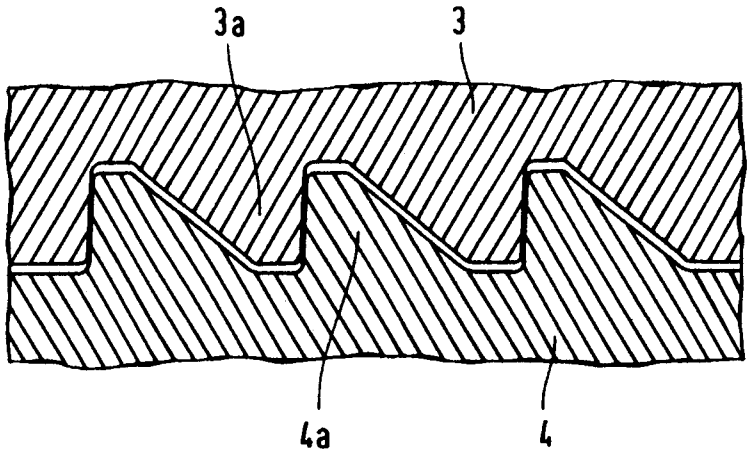
FIG. 2 is an enlarged sectional view of the connection between the parts embodying the present invention.

As shown more clearly in FIG. 2, clearances exist between the individual flanks of the sawtooth-shaped threads 3*a*, 4*a*. The clearances afford the limited axial displaceability of the cartridge carrier 4 relative to the housing part 3. The clearances between the flanks of the sawtooth-shaped threads 3*a*, 4*a* is arranged so that the amount of the limited axial displaceability between the cartridge carrier 4 and the housing part 3 in the axial direction of the piston 1 is in the range of 0.1 mm to 0.3 mm.

In accordance with the invention, the piston return effect is achieved initially in that with the ignition of a propellant charge within the cartridge chamber 4*d*, the propellant gases generated flow through the throughbore 4*e* and act on the rear end of the piston 1, driving it from the rear starting position to the front end position. As a result, the rearward region 1*a* of the piston 1 moves out of the receiving bore 4*b*, permitting a portion of the propellant gases to flow through the opening 6 into the channel 5. Within the front end of the channel 5 these propellant gases pass through the opening 7 back into the guide bore 2*a* and are compressed by the movement of the piston 1 in the setting direction. Due to the compressed propellant gases, the piston 1 is returned from its front end position into its rear starting position after the driving operation is completed. As it completes its return movement, the rearward region 1*a* of the piston 1 impacts against the base 4*c* of the cartridge carrier 4, whereby due to the shock transmission the piston 1 is stopped and the cartridge carrier 4 is moved opposite to the setting direction for the dimension of the limited axial displacement. This limited axial displacement is defined in the illustrated embodiment by the clearance between the flanks of the sawtooth-shaped threads 3*a*, 4*a*. The displaceability effect can be further assisted by the elasticity of the cartridge carrier 4 which is inherent either in its material properties or in its shape, wherein its shape can be provided by an axially extending slot 4*f* in the region of the sawtooth-shaped thread 3*a*, 4*a*. After moving opposite to the setting direction, the cartridge carrier 4 is moved again in setting direction due to this elastic action as well as due the rebound effect between the tooth flanks after the clearance has been used up, so that the cartridge carrier again assumes its starting position as shown in FIG. 1, whereby no dead space exists between the rearward region 1*a* of the piston 1 and the base 4*c* of the receiving bore 4*b*.

Note that the flanks of the threads 3*a*, 4*a* extend outwardly generally perpendicularly to the piston axis, then opposite to the setting direction and finally are inclined inwardly opposite to the setting direction towards the axis of the piston.

While a specific embodiment of the invention has been shown and described in detail to illustrate the inventive principles, it will be understood that the invention may be embodied otherwise without departing from said principles.

I claim:

1. An explosive powder charge operated setting tool comprises an axially extending tubular piston guide (2) having a front end and a rear end spaced apart in the axial direction and forming an axially extending guide bore (2*a*), a piston (1) mounted within said guide bore and displaceable therein between a rear starting position adjacent the rear end of said piston guide (2) and a front end position spaced axially from the rear starting position toward the front end of said piston guide (2), a cartridge carrier (4) located at the rear end of said piston guide (2) and forming a rear stop for said piston (1) in the rear starting position, a housing part (3) laterally enclosing said piston guide (2) with an axially extending channel (5) located between said housing part and piston guide, a first opening (6) connecting said guide bore (2*a*) and said channel (5) in an axially extending region of said rear starting position and a second opening (7) connecting said guide bore (2*a*) and said channel (5) in an axially extending region of said front end position, wherein the improvement comprises means for permitting displacement to a limited extent in the axial direction of the cartridge carrier (4) relative to one of said piston guide (2) and housing part (3).

2. An explosive powder charge operated setting tool, as set forth in claim 1, wherein said cartridge carrier (4) is displaceable to a limited extent in the axial direction of said piston (1) relative to said housing part (3) laterally enclosing said piston guide (2).

3. An explosive powder charge operated setting tool, as set forth in claim 2, wherein said means for permitting displacement comprises a connection between said cartridge carrier (4) and the housing part (3) for permitting the limited displaceability therebetween.

4. An explosive powder charge operated setting tool, as set forth in claim 3, wherein said connection is a threaded connection comprising clearances affording axial displaceability between said cartridge carrier (4) and said housing part (3).

5. An explosive powder charge operated setting tool, as set forth in claim 4, wherein said threaded connection comprises a sawtooth-shaped thread (3*a*) on said housing part (3) and a sawtooth-shaped thread (4*a*) on said cartridge carrier (4) and said sawtooth-shaped threads (3*a*, 4*a*) having flanks with corresponding flanks thereon extending inwardly inclined relative to the axis of said piston (1) and toward the rear end of said piston guide (2).

6. An explosive powder charge operated setting tool, as set forth in claim 5, wherein said cartridge carrier (4) comprises axially extending slots (4*f*) in the region of said sawtooth-shaped thread (4*a*) and open at an end of said cartridge carrier (4) closer to the front end of said piston guide (2).

7. An explosive powder charge operated setting tool, as set forth in claim 6, wherein the limited axial displaceability of said cartridge carrier (4) relative to said housing part (3) is in the range of 0.1 mm to 0.3.

8. An explosive powder charge operated setting tool, as set forth in claim 3, wherein said cartridge carrier (4) has a mass corresponding approximately to 1 to 3 times a mass of the said piston (1).

* * * * *